US006045352A

United States Patent [19]

Nicholson

[11] Patent Number: 6,045,352

[45] Date of Patent: Apr. 4, 2000

[54] CARBON MONOXIDE AUTOMATIC FURNACE SHUTDOWN SYSTEM

[76] Inventor: Leroy E. Nicholson, 7000 Paris Rd., Baltimore, Md. 21207

[21] Appl. No.: 09/314,952

[22] Filed: May 20, 1999

Related U.S. Application Data

[60] Provisional application No. 60/090,739, Jun. 25, 1998.

[51] Int. Cl.[7] ..... F23N 5/24

[52] U.S. Cl. ..... 431/22; 431/16; 431/76; 126/116 A

[58] Field of Search ..... 431/76, 16, 22; 126/116 A

[56] References Cited

U.S. PATENT DOCUMENTS

| | | | |
|---|---|---|---|
| 4,088,986 | 5/1978 | Boucher . | |
| 4,263,928 | 4/1981 | Kobayashi et al. . | |
| 4,787,410 | 11/1988 | Fujieda et al. . | |
| 4,974,624 | 12/1990 | Gotanda . | |
| 5,239,980 | 8/1993 | Hilt et al. | 431/22 |
| 5,419,358 | 5/1995 | Sun . | |
| 5,477,913 | 12/1995 | Polk | 431/22 |
| 5,550,375 | 8/1996 | Peters et al. . | |
| 5,575,274 | 11/1996 | De Palma | 431/22 |
| 5,638,847 | 6/1997 | Hoch, Jr. et al. . | |
| 5,651,248 | 7/1997 | Kawamara . | |
| 5,671,773 | 9/1997 | Park . | |
| 5,722,448 | 3/1998 | Dourado . | |
| 5,730,170 | 3/1998 | Sanchez . | |
| 5,896,089 | 4/1999 | Bowles | 431/22 |

FOREIGN PATENT DOCUMENTS

| | | |
|---|---|---|
| 57-129974 | 8/1982 | Japan . |
| 57-163786 | 10/1982 | Japan . |

*Primary Examiner*—Carroll Dority
*Attorney, Agent, or Firm*—Richard C. Litman

[57] ABSTRACT

An automatic safety system for a fluid fuel air heating furnace. The safety system utilizes a double-sided carbon monoxide sensor for detecting unsafe levels of carbon monoxide interiorly and exteriorly of the furnace's heated air duct and a single-sided carbon monoxide sensor for detecting unsafe levels of carbon monoxide interiorly of the furnace's flue pipe. The sensors employ carbon monoxide detector chips which are electrically conductive in normal conditions, but become non-conductive when exposed to levels of carbon monoxide that are deemed unsafe for humans. The sensors are incorporated in an electrical circuit for energizing a solenoid valve which valve, when energized, opens to permit fuel flow to the furnace. Detection of unsafe levels of carbon monoxide will result in the sensors becoming non-conductive, thereby causing the solenoid valve to become de-energized and to close thereby preventing fuel flow to the furnace.

15 Claims, 2 Drawing Sheets

CARBON MONOXIDE AUTOMATIC FURNACE SHUTDOWN SYSTEM

CROSS-REFERENCE TO RELATED APPLICATION

This application claims the benefit of U.S. Provisional Patent Application Ser. No. 60/090,739, filed Jun. 25, 1998.

BACKGROUND OF THE INVENTION

1. Field of the Invention

The present invention relates generally to safety devices for fluid handling systems and, more specifically, a system which automatically shuts down an air heating furnace in the event of detection of unsafe levels of carbon monoxide in or around the heated air duct of the furnace or in the furnace flue pipe.

2. Description of Related Art

The spate of injuries and deaths caused by accidental leakage of carbon monoxide gas from malfunctioning furnaces has spawned the invention of a number of systems for automatically interrupting flow of fuel to the furnace upon a detection of unsafe levels of carbon monoxide. Heretofore, the prior art systems have relied on detection devices positioned in the "living space" i.e. the space occupied by humans. Examples of such prior art systems are shown in U.S. Pat. Nos. 4,088,986 (Boucher), 4,263,928 (Kobayashi et. al.), 4,787,410 (Fujieda et. al.), 4,974,624 (Gotanda), 5,419,358 (Sun), 5,722,448 (Dourado), and Japanese Patent Abstracts 57129974 and 57163786.

U.S. Pat. Nos. 5,638,847 (Hoch, Jr. et al.) and 5,671,773 (Park) disclose sensors for detecting the flow of liquids.

U.S. Pat. No. 5,651,248 (Kawamara) shows a sensor for detecting the accumulation of particulate matter.

U.S. Pat. No. 5,550,375 (Peters et al.) discloses a system for detecting gases by utilization of a spectrometer.

U.S. Pat. No. 5,730,170 shows a burner cutoff system responsive to accidental fire.

None of the above inventions and patents, taken either singly or in combination, is seen to disclose a system wherein fuel is shut off from a furnace burner upon detection of unsafe levels of carbon monoxide either interiorly or exteriorly of a furnace heated air duct or in the furnace flue pipe as will subsequently be described and claimed in the instant invention.

SUMMARY OF THE INVENTION

The instant invention comprises a double-sided carbon monoxide sensor mounted on the heated air duct of a gaseous fuel fired heating furnace. One side of the sensor is exposed to the heated air flowing inside of the duct. The other side of the sensor is exposed to ambient air exterior of the duct. The sensor is incorporated in an electrical circuit in series with the winding of a solenoid valve. The solenoid valve is disposed in the fuel supply line of a gaseous fuel burner(s) and controls the flow of fuel (on-off) to the burner. Detection of unsafe levels of carbon monoxide, either inside the heated air duct or in the ambient air exterior of the duct, will cause the sensor to fail, thereby interrupting current flow to the solenoid valve. The valve will close and shut off the flow of fuel to the burner(s).

A single-sided carbon monoxide sensor is mounted in the flue pipe of the gaseous fuel fired heating furnace. The single-sided sensor is exposed to the combustion exhaust gases flowing through the flue pipe from the furnace combustion chamber. The instant sensor is also incorporated in the electrical circuit in series with the winding of the solenoid valve. Detection of unsafe levels of carbon monoxide in the flue pipe is indicative of improper combustion. Such detection will cause the sensor to fail, thus causing the valve to close and shut off flow of fuel to the burner(s).

Accordingly, it is a principal object of the invention to provide an automatic fuel shut off safety system for an air heating furnace.

It is another object of the invention to provide an automatic fuel shut off safety system which is responsive to unsafe levels of carbon monoxide in a flue pipe of an air heating furnace.

It is a further object of the invention to provide an automatic fuel shut off safety system which is responsive to unsafe levels of carborn monoxide interior of a heated air duct in an air heating furnace.

Still another object of the invention is to provide an automatic fuel shutoff safety system which is responsive to unsafe levels of carbon monoxide in the ambient air exterior of a heated air duct in an air heating furnace.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
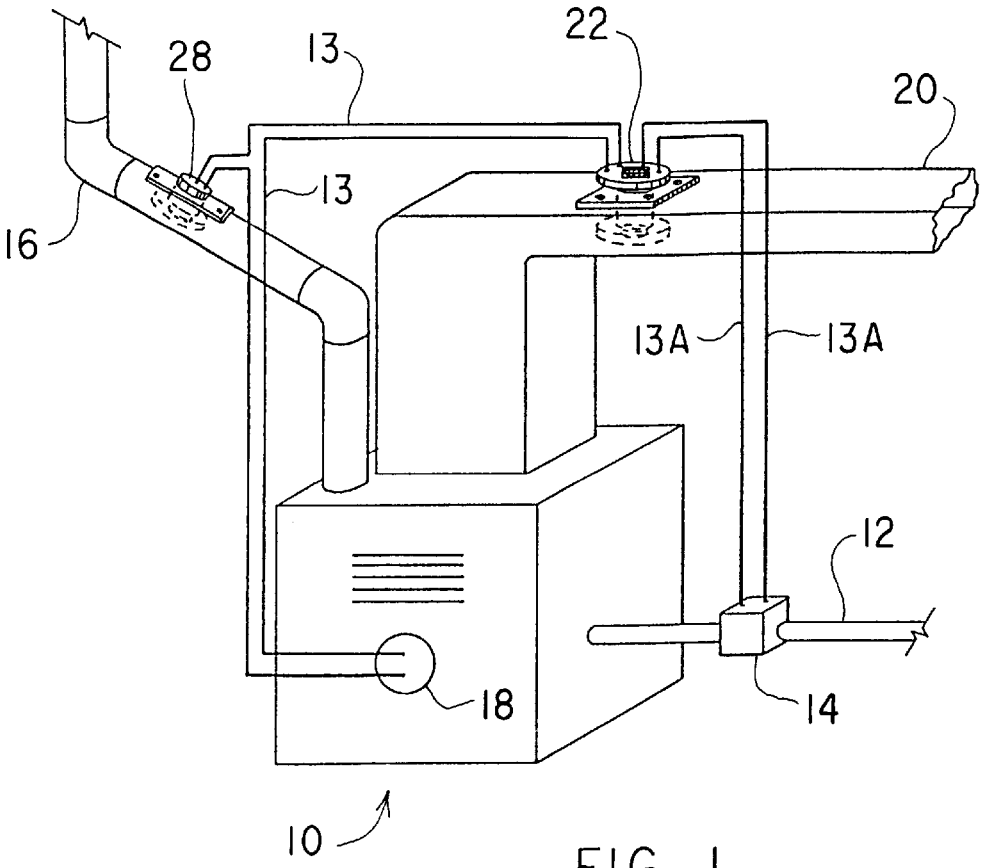
FIG. 1 is an environmental view of an air heating furnace incorporating the automatic shutdown system according to the present invention.

With reference to FIG. 1, the present invention comprises a gaseous fuel fired air heating furnace designated generally at 10. Conduit 12 supplies gaseous fuel, for combustion in furnace 10, via a standard solenoid valve 14. A heated air duct 20 conducts heated air from the furnace for distribution in a dwelling, or the like. A flue pipe 16 is conventionally connected to furnace 10 for conducting combustion gases to an exterior exhaust area. A blower 18 provides motive force for propelling air to be heated through the furnace 10 and through duct 20.

The air heating furnace 10 includes a combustion chamber, a pilot burner, a main burner(s), and air heating passages surrounding the combustion chamber. All of the instant elements and arrangements (not shown) are conventional, well known in the furnace art, and are not part of the inventive concept per se.

Figure 2:
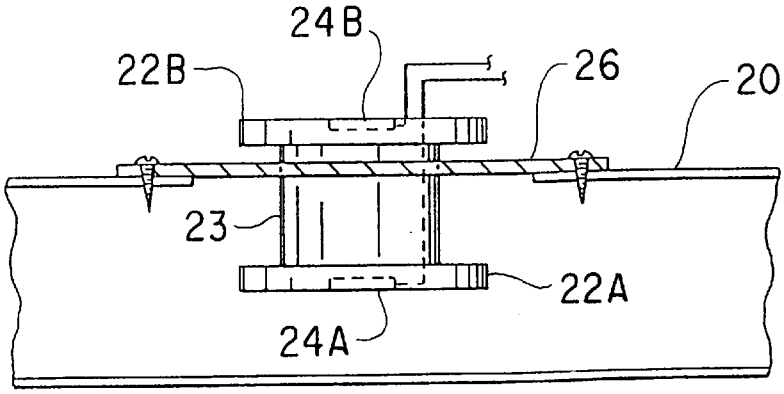
FIG. 2 is a cut-away detail of the shutdown device installed in a heated air duct.

A double sided carbon monoxide sensor 22 is positioned to extend through heated air duct 20 at a point two to three feet downstream from the furnace. As best seen in FIG. 2, sensor 22 structurally comprises two identical disk-shaped sections 22*a* and 22*b* joined by a cylindrical axis 23. Each section 22*a*, 22*b* has an outside surface with respective electrical conducting carbon monoxide detector chips 24*a* and 24*b* replaceably attached thereto. Chips 24*a*, 24*b* are designed to be electrically conductive until unsafe levels of carbon monoxide are detected, at which point the chips will fail and become permanently electrically non-conductive.

Sensor 22 is inserted in heated air duct 20 (FIG. 2) so that one section (22*a*) is exposed to heated air flowing through duct 20. The other section (22*b*) is exposed to ambient air exterior of duct 20. A removable gasket 26 functions to seal sensor 22 in heated air duct 20 thug preventing the escape of heated air from around the sensor. The gasket may be fastened to the duct by any effective means.

Figure 3:
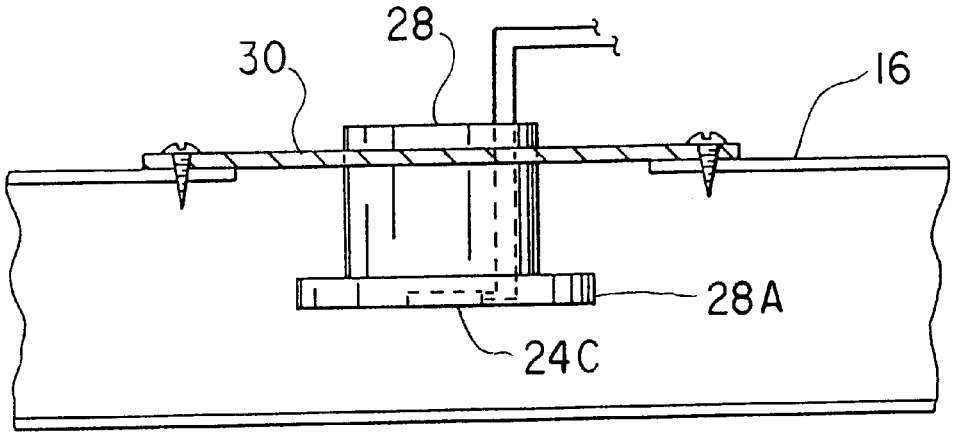
FIG. 3 is a cut-away detail of the shutdown device installed in a flue pipe.

A single-sided carbon monoxide sensor 28 is disposed in flue pipe 16. As best seen in FIG. 3, sensor 28 is provided with a single disk-shaped section 28*a*. A carbon monoxide detector chip 24*c* is attached to an outer surface of disk-shaped section 28*a*. A removable gasket 30 seals sensor 28 in flue pipe 16 to prevent escape of combustion gases.

Electric current is taken off blower 18 via lines 13 and 13*a*. Lines 13, 13*a* form an electric circuit which energizes solenoid valve 14. The formed electric circuit includes sensors 26 and 22 and is designed so that the carbon monoxide detector chips 24*a*, 24*b*, and 24*c* are connected in series.

Unsafe levels of carbon monoxide detected either within flue pipe 16, within air heating duct 20, or in the air surrounding duct 20 will cause failure of at least one of chips thereby interrupting the electric circuit, causing solenoid valve 14 to be de-energized and to close thereby stopping fuel flow to the burner(s).

Closing solenoid 14 will obviously eliminate the production of carbon monoxide caused by improper combustion. Upon repair or adjustment of the furnace to proper working order, the failed chip(s) must be replaced to restore the integrity of the safety system.

A system similar to that described above can be installed in an environment where the presence of carbon monoxide is both particularly hazardous and difficult to sense by a person without mechanical assistance. For example, an automobile, van, mobile home, boat, etc. can include a first system activating visual or audible alarm(s) when a first level of carbon monoxide is sensed, and a second system, shutting off the engine, when a second level of carbon monoxide is sensed.

It is to be understood that the present invention is not limited to the embodiments described above, but encompasses any and all embodiments within the scope of the following claims.

I claim:

1. An automatic safety system for a fluid fuel air heating furnace comprising:

means for supplying a fluid fuel to said furnace, said means including a solenoid valve for controlling flow of said fluid fuel;

a duct connected to said furnace for receiving heated air therefrom;

a sensor attached to said duct, said sensor having means to detect unsafe levels of carbon monoxide both within said duct and exteriorly of said duct.

2. The automatic safety system as defined in claim 1, wherein said sensor includes two identically structured disk-shaped portions axially spaced and connected by a cylindrical axis, each disk-shaped portion having an outer surface.

3. The automatic safety system as defined in claim 2, wherein said means to detect unsafe levels of carbon monoxide comprises electrically conductive carbon monoxide detector chips removably attached to said outer surface of each disk-shaped portion.

4. The automatic safety system as defined in claim 3, wherein an electric circuit is disposed to provide electric current to said solenoid valve and said detector chips are connected in series in said electric circuit.

5. The automatic safety system as defined in claim 4, wherein said sensor is mounted in a gasket and said gasket is removably attached to said duct.

6. The automatic safety system as defined in claim 5, wherein one of said two identically structured disk-shaped portions is positioned inside said duct.

7. The automatic safety system as defined in claim 6, wherein one of said two identically structured disk-shaped portions is positioned outside said duct.

8. An automatic safety system for a fluid fuel air heating furnace comprising:

means for supplying a fluid fuel to said furnace, said means including a solenoid valve for controlling flow of said fuel;

a duct connected to said furnace for receiving heated air therefrom;

a first sensor attached to said duct, said first sensor having first means to detect unsafe levels of carbon monoxide both within said duct and exteriorly of said duct;

a flue pipe connected to said furnace for conducting combustion gases therefrom;

a second sensor attached to said flue pipe, said second sensor having second means to detect unsafe levels of carbon monoxide within said flue pipe.

9. The automatic safety system as defined in claim 8, wherein said second sensor includes a disk-shaped portion positioned within said flue pipe, said disc shaped portion having an outer surface.

10. The automatic safety system as defined in claim 9, wherein said second means to detect unsafe levels of carbon monoxide comprises an electrically conductive carbon monoxide detector chip removably attached to said outer surface.

11. The automatic safety system as defined in claim 10, wherein said first sensor includes two identically structured disk-shaped portions axially spaced and connected by a cylindrical axis, each of said two disk-shaped portions having an outer surface.

12. The automatic safety system as defined in claim 11, wherein said first means to detect unsafe levels of carbon monoxide comprises electrically conductive carbon monoxide detector chips removably attached to the outer surface of each of said two disk-shaped portions.

13. The automatic safety system as defined in claim 12, wherein an electric circuit is disposed to provide electric current to said solenoid valve and said first means and said second means to detect unsafe levels of carbon monoxide are connected in series in said electric circuit.

14. The automatic safety system as defined in claim 13, wherein said first sensor is mounted in a first gasket and said first gasket is removably attached to said duct.

15. The automatic safety system as defined in claim 14, wherein said second sensor is mounted in a second gasket and said second gasket is attached to said flue pipe.

* * * * *